US005273191A

United States Patent [19]

Meshberg

[11] Patent Number: 5,273,191

[45] Date of Patent: Dec. 28, 1993

[54] DISPENSING HEAD FOR A SQUEEZE DISPENSER

[76] Inventor: Philip Meshberg, 2770 S. Ocean Blvd., Apt. 602, Palm Beach, Fla. 33480

[21] Appl. No.: 914,122

[22] Filed: Jul. 17, 1992

Related U.S. Application Data

[63] Continuation-in-part of Ser. No. 846,631, Mar. 5, 1992, and a continuation-in-part of Ser. No. 747,342, Aug. 20, 1991, abandoned.

[51] Int. Cl.[5] ..... B65D 35/56

[52] U.S. Cl. ..... 222/105; 222/212; 222/402.1; 222/494; 222/496; 239/452

[58] Field of Search ..... 222/1, 105, 206, 212, 222/215, 402.1, 481.5, 482, 490, 491, 494, 496; 239/452, 533.1, 570; 137/493.8, 509, 510, 606, 895

[56] References Cited

U.S. PATENT DOCUMENTS

| | | | |
|---|---|---|---|
| 1,972,344 | 9/1934 | Jackson | 222/494 |
| 3,010,613 | 11/1961 | Stossel | 222/190 |
| 3,088,636 | 5/1963 | Spatz | 222/213 |
| 3,176,883 | 4/1965 | Davis | 222/193 |
| 3,223,289 | 12/1965 | Bouet | 222/209 |
| 3,268,123 | 8/1966 | Spatz | 222/400.5 |
| 3,319,836 | 5/1967 | Cubitt | 222/207 |
| 3,360,169 | 12/1967 | Susuki et al. | 222/494 X |
| 3,858,773 | 1/1975 | Del Bon | 222/494 |
| 3,913,804 | 10/1975 | Laauwe | 222/402.11 |
| 3,990,640 | 11/1976 | Laauwe | 239/533 |
| 4,008,830 | 2/1977 | Meshberg | 222/95 |
| 4,057,177 | 11/1977 | Laauwe | 222/481.5 X |
| 4,113,145 | 9/1978 | Meshberg | 222/1 |
| 4,159,790 | 7/1979 | Bailey | 222/211 |
| 4,230,242 | 10/1990 | Meshberg | 222/321 |
| 4,457,454 | 7/1984 | Meshberg | 222/95 |
| 4,457,455 | 7/1984 | Meshberg | 222/95 |
| 4,506,809 | 3/1985 | Corsette | 222/213 |
| 4,615,467 | 10/1986 | Grogan et al. | 222/189 |
| 4,646,945 | 3/1987 | Steiner et al. | 222/207 |
| 4,696,415 | 9/1987 | Meshberg | 222/82 |
| 4,723,725 | 2/1988 | Comment | 239/533.1 |
| 4,760,937 | 8/1988 | Evezich | 222/95 |
| 4,798,311 | 1/1989 | Workum | 222/131 |
| 4,846,376 | 7/1989 | Palmer | 222/190 |
| 4,867,352 | 9/1989 | Meshberg | 222/402.16 |
| 4,940,170 | 7/1990 | Popp-Ginsbach | 222/402.1 |
| 5,042,697 | 8/1991 | Warren | 222/402.1 |
| 5,048,750 | 9/1991 | Tobler | 222/212 X |
| 5,099,885 | 3/1992 | Nilsson | 222/207 X |
| 5,197,638 | 3/1993 | Wood | 222/212 |

*Primary Examiner*—Andres Kashnikow
*Assistant Examiner*—J. A. Kaufman
*Attorney, Agent, or Firm*—Kenyon & Kenyon

[57] ABSTRACT

A dispensing head for a squeeze dispenser is disclosed. The dispensing head includes a mixing chamber where pressurized air and pressurized fluid are mixed to produce a fine spray. A valved gasketing arrangement is used to control the flow of air into the container and out of the dispensing head, as well as to control flow of liquid to the dispensing head and to prevent leakage when the dispenser is inverted. The dispensing head also includes a liquid flow control device. This device uses a spring-biased piston to shut off the liquid flow path when the liquid is not pressurized. The piston acts to seal off the liquid from the atmosphere, thus preventing drying or contamination of the liquid product. A collapsible bag is also disclosed for isolating the liquid in the container from the air in the container.

19 Claims, 3 Drawing Sheets

DISPENSING HEAD FOR A SQUEEZE DISPENSER

RELATED APPLICATIONS

This application is a continuation-in-part of U.S. application Ser. No. 07/846,631, filed Mar. 5, 1992, and a continuation-in-part of U.S. application Ser. No. 07/747,342, filed Aug. 20, 1991 now abandoned.

BACKGROUND OF THE INVENTION

The invention relates to a dispensing head for a dispenser which is pressurized by squeezing the sides of the container. More particularly, the invention is directed to a dispensing head in which air and liquid are mixed to produce a fine spray, and in which there is a venting arrangement with an anti-leak feature, and a flow controller for sealing off the dispensed liquid from the atmosphere when the dispenser is not in use.

There are several different techniques for dispensing a fluid substance in a fine mist. One technique is to provide a resilient dispensing bottle with an outlet orifice such that as the bottle is squeezed by a user, pressure builds up within the container. The pressure in the container forces any liquid within the container out a dispensing orifice, which can be structured to produce a fine mist of liquid. Often, however, it is difficult to arrive at a particularly fine mist in such a dispenser solely through the use of a shaped orifice. Furthermore, the conventional means for providing an outlet valve-a ball valve-is generally expensive to manufacture, thus increasing the cost of the dispenser to the end user.

A technique used to eliminate some of the above disadvantages is disclosed in U.S. patent application Ser. No. 745,538, which is incorporated by reference. In this invention, a squeeze bottle has a liquid flow path and an air flow path. When the bottle is squeezed, liquid is transmitted through the liquid flow path and pressurized air through the air flow path. These two flows meet in a mixing chamber which is located adjacent an outlet orifice. The air and liquid mix to form a fine spray. The disadvantage of this arrangement is that it requires the use of a relatively expensive ball valve for the liquid outlet, and liquid will leak out of the dispenser when the bottle is inverted, because the air path is completely open to fluid flow. Furthermore, in this arrangement, the outlet orifice and the air vent path allow air to be in continuous contact with the liquid to be dispensed. This can result in drying of the liquid substance—an disadvantageous result which can clog the outlet orifice and prevent proper spraying.

SUMMARY OF THE INVENTION

The drawbacks of the above described arrangement are overcome by the apparatus of the present invention. In the present invention, a special valved gasket arrangement is provided which provides several advantageous features. The gasket arrangement has a centrally located flap valve, which is used in place of the conventional ball valve for the outlet. This reduces the cost of manufacture of the dispenser. The gasket arrangement also includes a one-way flap valve for inlet air into the dispensing bottle. This valve allows the dispenser to vent properly, while still allowing a pressure build-up in the bottle during squeezing. The gasket arrangement includes another one-way flap valve for outlet air from the dispensing bottle. This outlet air is used to intermingle with the dispensed liquid to produce a desirable fine mist. The outlet valve is configured such that it allows only a certain amount of outlet air, so as not to prevent squeeze-actuated dispensing. The valve is also configured to respond to only a certain threshold pressure level, so that it will open during squeeze-induced pressurization, but it will not open when the dispenser is in an inverted position. This allows proper dispensing, and still prevents leakage when the bottle is not in an upright position. The gasket also functions to seal the bottle from leakage.

The also invention provides an apparatus for controlling the discharge of fluid product that has a body portion with an internal bore having a discharge end closed by a wall and a second closed end. A piston is slidably disposed within the bore and divides the bore axially into a high-pressure chamber bounded by said wall and a low-pressure chamber and being movable between a first, non-operated position and a second, operated position. A discharge passage extends through the wall and has an inlet end in fluidic communication with the high-pressure chamber. A valve seat is formed on the wall around said inlet end of said discharge passage. An inlet passage extends through the body portion and has a discharge end in fluidic communication with the high-pressure chamber. A spring biases the piston toward the wall and a valve member connected to the piston sealingly engages the valve seat to fluidically isolate the discharge passage from the high-pressure chamber when the piston is in its first, non-operated position and moves out of sealing engagement with the valve seat when the piston is displaced toward its second, operated position. Thus, when liquid product having a pressure greater than a predetermined value is introduced into the high-pressure chamber via the inlet passage the liquid product displaces the piston toward the second, operated position and is discharged from the high-pressure chamber via the discharge passage. The discharge passage is connected to a mixing chamber where air and liquid product are mixed to produce a fine mist.

The above feature thus seals the discharge orifice of the dispenser automatically when the dispenser stops discharging product and maintains the seal until the dispenser next discharges product. The apparatus prevents infiltration of air into the internal passages of the dispenser containing liquid product, thus inhibiting clogging of the passages and maintaining sterility of the product.

DETAILED DESCRIPTION

Figure 1:
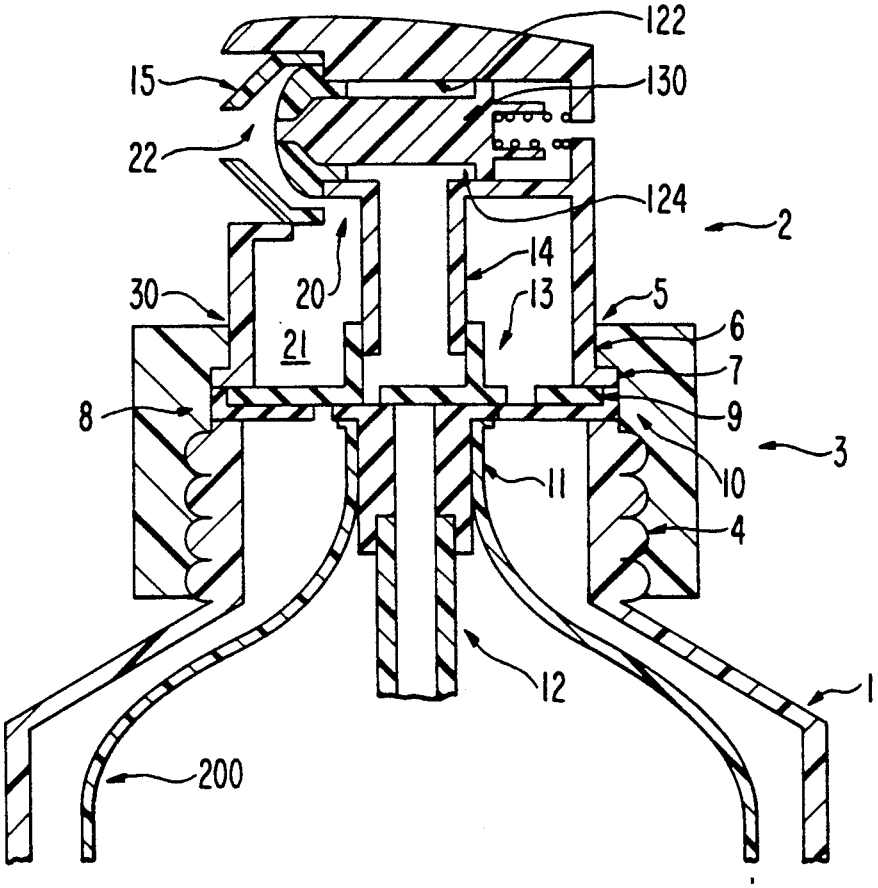
FIG. 1 is cross-sectional view of a dispensing bottle including the dispensing head of the present invention.

As illustrated in FIG. 1, the instant invention is directed towards a valving structure for a squeeze bottle dispenser. The dispenser includes a bottle 1, a dispensing housing 2, and housing mounting cap 3. Bottle 1 is constructed of a resilient material. The neck of bottle 1 is threaded, and cooperates with threads 4 on housing mounting cap 3. Mounting cap 3 has a centrally located hole 5 and flange 6 which cooperate with housing 2 and housing flange 7 to secure housing 2 to bottle 1 when the cap 3 is screwed onto the neck of bottle 1.

Captured between the top of bottle 1 neck and the bottom of flange 7 is a gasket arrangement 8. Gasket arrangement 8 consists of upper gasket member 9 and lower gasket member 10. Lower gasket member 10 has a centrally located annular projection 11 designed to sealingly engage and hold a dip tube 12. Upper gasket member has a centrally located annular projection 13 which sealingly engages a fluid passage 14 in housing 2. The end of fluid passage 14 opposite the annular projection 13 leads to a dispensing nozzle 15, which can be a separate unit inserted into housing 2. Housing 2 also has a vent path 20 connecting a vent chamber 21 in housing 2 with a spray chamber 22 in housing 2.

Within the spray head 2 is a flow controlling piston 130, and other associated mechanisms. These mechanisms are described below in reference to FIGS. 5 and 6. Although the piston 130 is shown in FIG. 1 as sliding in a bore 122 which is integral with the spray head 2, the bore 122 can alternatively be constructed of a separate inserted member, as will be described below. The flow controlling piston 130 acts to control the flow of liquid from the dispenser, and seals the liquid product off from the atmosphere when the dispenser is not in use. Sealing off the liquid product from the atmosphere prevents the liquid from drying and clogging the passages in the dispensing head 2, ensuring optimal dispensing throughout the lifetime of the dispensing head 2. The dispenser can also be provided with a collapsible bag 200 sealed to the annular projection 11. This bag 200 can be used to seal the liquid product in the dispenser from the venting and spray-inducing air within the container. Sealing the liquid product from air in the container is often necessary with products which can dry when exposed to air, or with products which must remain sterile.

Figure 2:
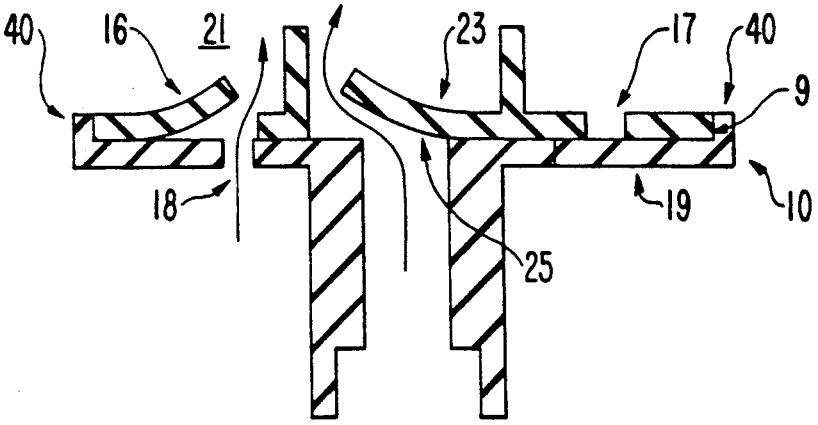
FIG. 2 is a cross-sectional view of the gasket structure of the present invention, showing the position of the valves during squeezing.

As shown in FIG. 2, upper gasket member 9 includes a flap valve 16 and a vent hole 17. Lower gasket member 10 includes a vent hole 18 opposite from and cooperating with flap valve 16. Lower gasket member 10 also includes a flap valve 19 opposite from and cooperating with vent hole 17. Upper gasket member 9 may also include an outlet flap valve 23 separating dip tube 12 from fluid passage 14. Alternatively, a ball valve could be used in place of outlet flap valve 23.

In operation, the bottle 1 is filled with a fluid to be dispensed through the bottle 1 neck, and the housing 2 is attached to bottle 1 by means of cap 3. As shown in FIG. 2, when liquid product is to be dispensed, a user squeezes the sides of bottle 1, thus increasing the pressure within bottle 1. Increased pressure in bottle 1 causes flap valve 19 to be forced against the part of upper gasket member 9 surrounding vent hole 17, thus closing off vent hole 17. At the same time, increased pressure causes air in the upper portion of bottle 1 to escape out of vent hole 18. This air pushes against, and opens, flap valve 16. Vent hole 18 is designed to be of a small enough size so that although it allows some air to escape out of the bottle 1, it does not exhaust all of the pressure increase in bottle 1. The pressure in bottle 1 also causes the fluid in the bottle to be forced up dip tube 12, unseating valve 23. Fluid continues to flow through passage 14 and into high-pressure chamber 124. As will be described below, sufficient pressure will cause fluid to flow from high pressure chamber 124, through liquid discharge passage 142, and into spray chamber 22. Air escaping through flap valve 16 passes through vent chamber 21 and vent path 20. Accordingly, pressurized fluid enters spray chamber 22 from passage 142, while pressurized air enters spray chamber 22 from vent path 20. The pressurized fluid and air combine in spray chamber 22 and exit through a nozzle orifice 24 in such a way that a fine mist of fluid is discharged through orifice 24.

Figure 3:
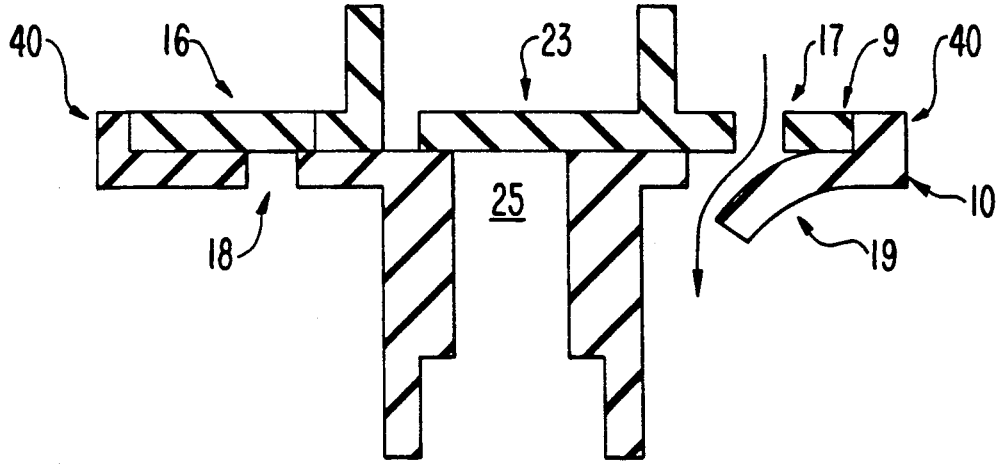
FIG. 3 is a cross-sectional view of the gasket structure of the present invention, showing the position of the valves during venting.

After squeezing pressure is released, the resiliency of bottle 1 causes the sides of bottle 1 to expand, thus descreasing the pressure within bottle 1 relative to atmospheric pressure. As shown in FIG. 3, this relative pressure difference causes outlet valve 23 to close against the portion of lower gasket member 10 surrounding outlet passage 25. Furthermore, the relative pressure also acts to close flap valve 16 against the portion of lower gasket member 10 surrounding vent hole 18. In contrast, the relative pressure difference acts to cause air to flow through vent hole 17 and to open flap valve 19 such that exterior air is vented into the interior of bottle 1. Air continues to enter through flap valve 19 until the resiliency of bottle 1 has caused it to resume its original shape.

Flap valve 16 is designed to be of sufficient resiliency such that it will not open due to the fluid pressure against it caused by inversion of bottle 1. Accordingly, when the bottle is inverted, fluid will not leak out vent hole 18 to vent path 20 and out orifice 24. However, flap valve 16 is designed so that it will open when sufficient force is applied to bottle 1 during a dispensing operation, such that pressurized air can escape through flap valve 16 to allow the escaping air to generate a fine mist in spray chamber 22. If flap valve 23 is used in place of a ball valve, it is constructed similar to flap valve 16. Thus, flap valve 23 has sufficient resiliency such that it will not open due to fluid pressure against it when the bottle 1 is inverted. Flap valve 23 will, however, open in response to fluid pressure on it caused by squeezing of bottle 1.

Preferably, upper gasket member 9 and lower gasket member 10 are constructed of a relatively resilient substance, for example an elastomer. Resiliency allows the gasket members to seal the bottle 1 neck against the housing 3 to prevent leakage, and allows flap valves 16 and 19 to operate in the manner described above. Upper gasket member 9 can also include an attached hinged sealing member 26 which can swing about hinge 30 into engagement with nozzle 15 to seal it against the incursion of air and dirt, as well as providing an added degree of leakproofing beyond flap valve 16.

Figure 4:
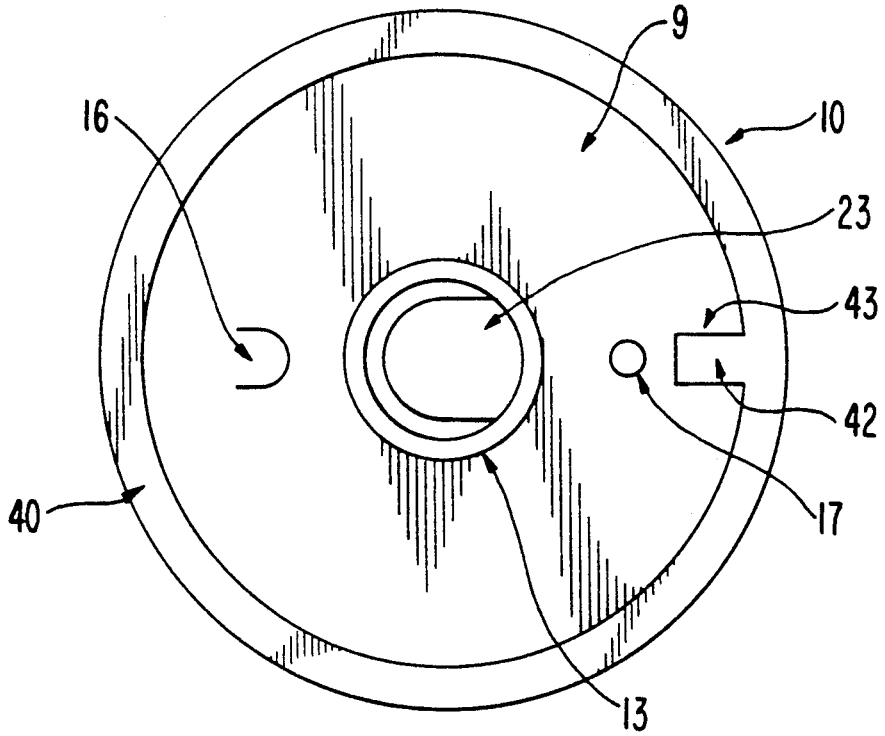
FIG. 4 is a top view of the gasket structure of the present invention, showing the arrangement for assembly.

FIG. 4 shows an arrangement for assembling the gasket arrangement 8. Because it is necesary that the flap valves 16 and 19 are aligned with the holes 17 and 18, it is desirable to have an arrangement which makes such alignment easy during an assembly operation. In the preferred embodiment, this is done by having an upstanding annular ridge 40 on lower gasket 10. This ridge 40 allows the upper gasket 9 to be nested within the ridge, so that the two gaskets 9 and 10 are connected together. To ensure that the flap valves 16 and 19 are aligned with the holes 17 and 18, there are one or more keys 42 on ridge 40 which engage keyways 43 in gasket 9. By engaging key 42 in keyway 43, it is ensured that the gaskets 9 and 10 have the proper angular orientation relative to one another, and thus that the holes 17 and 18 are properly aligned with the valves 16 and 19.

Figure 5:
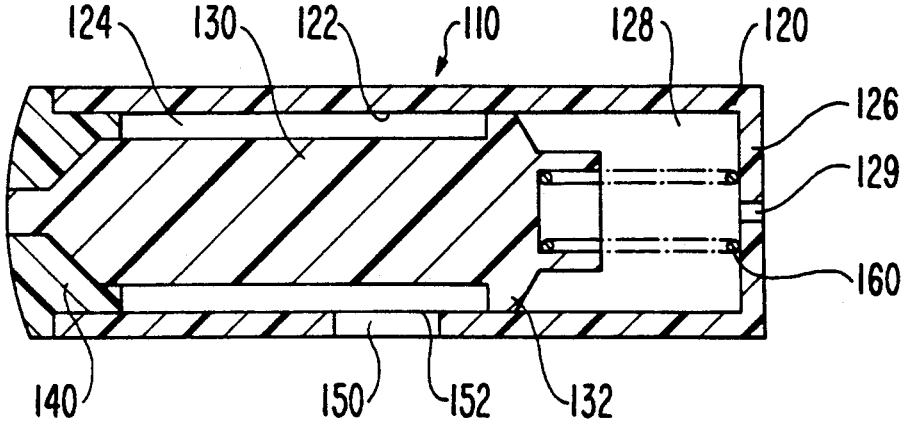
FIG. 5 is a detail view of the flow controller mechanism of the present invention, when the product is not being dispensed.
Figure 6:
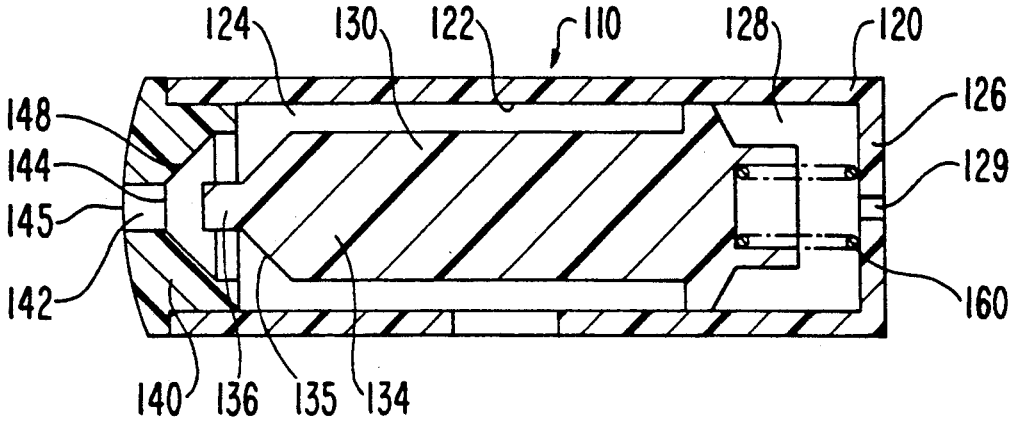
FIG. 6 is a detail view of the flow controller mechanism of the present invention, during product dispensing.

FIGS. 5 and 6 illustrate the flow control mechanism of the present invention. The mechanism 110 includes a generally cylindrical body portion 120 and a piston 130. The body portion 120 can be a separate member inserted into the spray head 2, or can be integrally formed with the spray head 2. The body portion 120 has a bore 122 formed at its inside diameter. The body portion is closed at both ends—a first, discharge end is closed by a plug 140, while the other end is closed by end portion 126 of the body portion.

The piston 130 is slidably disposed within the bore 122. The rim 132 of the piston 130 is in sealing contact with the bore 122. The rim of the piston divides the bore 122 into a high-pressure chamber 124 and a low-pressure chamber 128. Integrally formed with the piston 130 is a valve member 134, which, in the illustrated embodiment, has a conical portion 135 and a cylindrical end portion 136.

Plug 140 has a liquid discharge passage 142 formed therethrough. Passage 142 has an inlet end 144 that is in fluidic communication with the high-pressure chamber 124 and a discharge end 145 that is in fluidic communication with the atmosphere. A valve seat 148 is formed around the inlet end 144 of the discharge passage 142.

An inlet passage 150 extends through the body portion 120 and has a discharge end 152 in fluidic communication with the high-pressure chamber 124. In the illustrated embodiment, the inlet passage 150 is a single rectangular slot, but can also, for example, take the form of single or multiple circular openings.

A vent passage 129 is formed in the closed end of the bore. The vent passage 129 provides communication from the low pressure chamber 128 to the exterior of the body.

The piston 130 and integral valve member 134 are biased toward the plug 140 by a spring 160. The spring normally biases the piston and valve member into a non-operated position in which the valve member sealingly engages the valve seat, as shown in FIG. 5. In an operated position, as shown in FIG. 6, the piston and valve member are displaced away from the plug so that the valve member is separated from the valve seat and the high-pressure chamber is in fluidic communication with the atmosphere via the discharge passage 142.

In operation, liquid product is introduced into the high-pressure chamber via the inlet passage. When the pressure of the liquid product in the high-pressure chamber reaches a first threshold pressure, the force exerted by the liquid product on the high-pressure chamber side of the piston and the atmosphere on the end of the cylindrical end portion 136 of the valve member exceeds the sum of the force exerted by the air in the low-pressure chamber (which is at atmospheric pressure, since it communicates via vent passage 129 with the atmosphere) on the piston and the force exerted by the spring on the piston, thus displacing the piston away from the plug and out of the non-operated position. When the valve member is displaced out of sealing contact with the valve seat, liquid product is discharged from the discharge passage 142 and into the mixing chamber 22. The piston and valve member remain in an operated position until the pressure of the liquid product in the high-pressure chamber falls below a second threshold pressure. The second threshold pressure is the pressure at which the force that the liquid product exerts on the high-pressure chamber side of the piston falls below the sum of the spring force and the force that the air in the low-pressure chamber exerts on the piston. The valve member will then be urged by the spring into sealing contact with the valve seat, stopping the discharge of liquid product and sealing the high-pressure chamber from the atmosphere.

Product may tend to seep past the seal between the bore 122 and the rim of the piston 132, accumulating in the low-pressure chamber. If the air volume in the low-pressure chamber is sufficiently reduced, the operation of the apparatus may be impaired. However, the vent passage 29 provides a path for the leaked product to escape from the low-pressure chamber.

What is claimed is:

1. A dispensing unit for a fluid container partially filled with a liquid to be dispensed and partially filled with air comprising:

a dispensing head, said dispensing head including two passageways and a dispensing orifice, said two passageways leading from an interior of said fluid container to said dispensing orifice, one of said passageways being for the passage of liquid and the other of said passageways being for the passage air, a piston, one of said passageways including said piston, an outlet opening and a biasing device, an end of said piston being biased by said biasing device to close said outlet opening;

an upper venting member connected to the underside of said dispensing head, said upper venting member comprising at least one hole and at least one flap valve; and a lower venting member connected to the underside of said upper venting member, said lower venting member comprising at least one hole and at least one flap valve, said at least one hole on said upper venting member being aligned with said at least one flap valve on said lower venting member so as to allow air flow from one of said passageways to an interior of said fluid container, and said at least one flap valve on said upper venting member being aligned with said at least one hole on said lower venting member so as to allow air flow from the interior of said fluid container to the other of said passageways.

2. The dispensing unit of claim 1, wherein:

said upper venting member is a resilient gasket and said lower venting member is a resilient gasket.

3. The dispensing unit of claim 1, wherein:

said upper venting member and said lower venting members include fluid flow passages cooperating with one another to allow fluid flow from said container to said one of said passageways.

4. The dispensing unit of claim 3, wherein:

said fluid flow passages are in fluid communication with a conduit extending below the level of said hole in said lower venting member.

5. The dispensing unit of claim 4 further comprising:

a collapsible bag for retaining fluid sealed to said conduit, said collapsible bag isolating fluid from air in said fluid container.

6. The dispensing unit of claim 1, wherein;

said upper venting member includes a second flap valve;

said lower venting member includes a second hole; and said second flap valve is aligned with said second hole to allow fluid flow from said fluid container to said one of said passageways.

7. The dispensing unit of claim 1, wherein:

said passageways meet in a spray chamber adjacent to, and in fluid communication with, said dispensing orifice.

8. The dispensing unit of claim 7, wherein:

said upper venting member and said lower venting members further comprise fluid flow passages cooperating with one another to allow fluid flow from said container to said one of said passageways.

9. The dispensing unit of claim 8, wherein:

said fluid flow passages are in fluid communication with a conduit extending below the level of said hole in said lower venting member, wherein air passes through said other of said passageways, and liquid passes through said one of said passageways.

10. The dispensing unit of claim 1, wherein:

said piston is contained within a bore, said piston including a rim sealingly engaging said bore and defining therewith a high-pressure chamber and a low-pressure chamber, said one of said passageways communicating with said high-pressure chamber, said biasing device located in said low-pressure chamber, whereby fluid pressure in said high-pressure chamber acts against said rim against the bias of said biasing device.

11. The dispensing unit of claim 10, wherein:

said low-pressure chamber is in fluid communication with the atmosphere.

12. A dispenser comprising:

a fluid container partially filled with a liquid to be dispensed and partially filled with air; and a dispensing unit attached to an open end of said fluid container;

said dispensing unit comprising:

a dispensing head with two passageways and a dispensing orifice, one of said passageways being for the passage of liquid and the other of said passageways being for the passage of air, a first of said two passageways including a bore, said dispensing head further comprising a piston within said bore, said piston being biased by a biasing device to close said first of said passages; and a venting member between said dispensing head and said fluid container;

said venting member including:

a first valve for allowing air to flow from said first of said two passageways to an interior of said container;

a second valve for allowing air to flow from an upper portion of said interior of said container to said first of said two passageways; and a conduit for allowing liquid to flow from a lower portion of the interior of said container to a second of said two passageways.

13. The dispenser of claim 12, wherein:

said second valve has sufficient resiliency so as not to open when said container is inverted when filled with fluid.

14. The dispenser of claim 12, wherein:

said second valve is sufficiently restrictive so as to prevent complete exhaustion of pressure within said container when said container is squeezed.

15. The dispenser of claim 12, wherein:

said venting member comprises upper and lower gaskets;

said first and second valve are flap valves;

said upper gasket comprises a third flap valve disposed above said conduit;

said two passageways meet in a chamber in fluid communication with said dispensing orifice.

16. The dispenser of claim 12, wherein:

said container includes a collapsible bag, said collapsible bag isolating fluid in said container from air in said container.

17. The dispensing unit of claim 12, wherein:

said piston includes a rim sealingly engaging said bore and defining therewith a high-pressure chamber and a low-pressure chamber, said first passageway communicating with said high-pressure chamber, said biasing means located in said low-pressure chamber, whereby fluid pressure in said high-pressure chamber acts against said rim against the bias of said biasing device to thereby open said first passageway.

18. The dispensing unit of claim 10, wherein:

said low-pressure chamber is in fluid communication with the atmosphere.

19. The dispensing unit of claim 12, wherein:

said container is made of a resilient material, such that hand pressure on said container pressurizes liquid and gas in the interior of said container to thereby dispense said liquid and air through said orifice.

* * * * *